US009208968B2

(12) United States Patent
Lin et al.

(10) Patent No.: US 9,208,968 B2
(45) Date of Patent: Dec. 8, 2015

(54) LIQUIDPROOF DOME SWITCH

(71) Applicant: Apple Inc., Cupertino, CA (US)

(72) Inventors: Gloria Lin, San Ramon, CA (US); Bruno Germansderfer, Boston, MA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 13/958,250

(22) Filed: Aug. 2, 2013

(65) Prior Publication Data

US 2014/0034473 A1 Feb. 6, 2014

Related U.S. Application Data

(63) Continuation of application No. 12/572,093, filed on Oct. 1, 2009, now Pat. No. 8,502,099.

(51) Int. Cl.

| | |
|---|---|
| ***H01H 13/06*** | (2006.01) |
| ***H01H 13/02*** | (2006.01) |
| ***H01H 1/64*** | (2006.01) |
| ***H01H 13/14*** | (2006.01) |
| ***H01H 13/26*** | (2006.01) |
| ***H01H 13/52*** | (2006.01) |
| ***H01H 11/04*** | (2006.01) |
| *H01H 13/10* | (2006.01) |
| *H01H 13/12* | (2006.01) |

(52) U.S. Cl.

CPC ..... *H01H 13/02* (2013.01); *H01H 1/64* (2013.01); *H01H 11/04* (2013.01); *H01H 13/14* (2013.01); *H01H 13/26* (2013.01); *H01H 13/52* (2013.01); *H01H 13/10* (2013.01); *H01H 13/12* (2013.01); *H01H 2201/01* (2013.01); *H01H 2205/002* (2013.01); *H01H 2215/004* (2013.01); *H01H 2215/006* (2013.01); *H01H 2215/012* (2013.01); *Y10T 29/49105* (2015.01)

(58) Field of Classification Search

CPC ..... H01H 13/52; H01H 13/28; H01H 13/26; H01H 1/64; H01H 1/24; H01H 2003/007; H01H 2215/004; H01H 2215/012; H01H 2215/006; H01H 2201/01

USPC ..... 200/302.2, 341

See application file for complete search history.

(56) References Cited

U.S. PATENT DOCUMENTS

| | | | |
|---|---|---|---|
| 5,145,058 | A | 9/1992 | Lee |
| 5,821,482 | A | 10/1998 | Ootani et al. |
| 6,303,887 | B1 | 10/2001 | Ando |
| 6,603,086 | B2 | 8/2003 | Kawaguchi et al. |
| 6,639,159 | B2 | 10/2003 | Anzai |

(Continued)

*Primary Examiner* — Felix O Figueroa

(74) *Attorney, Agent, or Firm* — Van Court & Aldridge LLP

(57) ABSTRACT

This is directed to a dome switch that may prevent liquid from coming into contact with circuit elements of the switch. A deformable dome may include a conductive inner surface region and may be placed over a conductive contact pad such that the dome may deform and the conductive elements may contact each other. At least one sheath may be positioned between the conductive region of the dome and the contact pad positioned below the dome for preventing liquid external to the one or more sheaths from contacting the conductive portions of the switch. In some embodiments, a first sheath may be coupled to the inner surface of the dome about the conductive inner surface region and a second sheath may be coupled to a mounting surface about the conductive contact pad, such that when a user deforms the dome, one of the sheaths may extend into the other sheath.

24 Claims, 5 Drawing Sheets

(56) References Cited

U.S. PATENT DOCUMENTS 7,829,813 B2 11/2010 Murase et al.
8,207,805 B2 * 6/2012 Wild et al. ..... 200/341
2001/0003326 A1 6/2001 Okada et al.
2010/0213044 A1 8/2010 Strittmatter et al.

* cited by examiner

LIQUIDPROOF DOME SWITCH

CROSS-REFERENCE TO RELATED APPLICATIONS

This application is a continuation of U.S. patent application Ser. No. 12/572,093 filed on Oct. 1, 2009 (now U.S. Pat. No. 8,502,099). The disclosure of this application is hereby incorporated by reference in its entirety.

FIELD OF THE INVENTION

This can relate to dome switches and, more particularly, to systems and methods for preventing liquids from contacting circuit elements of dome switches.

BACKGROUND OF THE DISCLOSURE

Dome switches are common to various electronic devices (e.g., portable media players and cellular telephones). A dome switch generally includes a dome having a conductive inner surface operative to close a circuit when the dome is deformed and the conductive inner surface is brought into contact with a conductive contact pad positioned under the dome. The conductive contact pad is usually provided on a circuit board of the electronic device, such that when the dome is physically deformed by a user, the circuit of the switch can provide electrical signals to other components of the electronic device.

If a user mistakenly pours liquid on the electronic device, the liquid can sometimes come into contact with the circuit elements of the dome switch (e.g., the conductive inner surface of the dome and/or the conductive contact pad). Water or any other foreign liquid coming into contact with one or more of the circuit elements may short the circuit of the dome switch.

SUMMARY OF THE DISCLOSURE

Systems and methods for preventing liquids from contacting circuit elements of a dome switch are provided.

In some embodiments, a dome switch may include a conductive contact pad coupled to a mounting surface and a dome coupled to the surface and positioned over the conductive contact pad. The dome may include a conductive dome region on an inner surface of the dome. The dome switch may also include at least one sheath extending between the conductive contact pad and the conductive dome region for preventing liquid external to the at least one sheath from contacting the conductive dome region and the conductive contact pad. The sheath may be deformable or rigid.

In some embodiments, a method for preventing liquid from harming a dome switch may include positioning a first sheath around the periphery of a conductive inner surface region of a dome of the switch. The method may also include positioning a second sheath around the periphery of a conductive contact pad of the switch. An open end of the second sheath may extend through an open end of the first towards the conductive inner surface region.

BRIEF DESCRIPTION OF THE DRAWINGS

The above and other features of the invention, its nature, and various advantages will be more apparent upon consideration of the following detailed description, taken in conjunction with the accompanying drawings in which.

DETAILED DESCRIPTION OF THE DISCLOSURE

Systems and methods for preventing liquids from contacting circuit elements of a dome switch are provided and described with reference to FIGS. 1-4A.

A dome switch may include a deformable dome having a conductive dome region on an inner surface of the dome. The deformable dome may be positioned over a conductive contact pad. The conductive contact pad may be, for example, a contact pad on a mounting surface (e.g., a surface of a circuit board). A first end of a first sheath may be coupled to the inner surface of the dome around at least a portion of the dome's conductive dome region, and the second end of the sheath may extend away from the dome towards the conductive contact pad. A first end of a second sheath may be coupled to the mounting surface around at least a portion of the periphery of the conductive contact pad, and the second end of the sheath may extend away from the contact pad towards the dome.

When a user presses an outer surface of the dome, the dome may deform such that the conductive dome region of the inner surface of the dome may contact the conductive contact pad positioned under the dome, thus, closing a circuit. When the dome deforms, the second end of the second sheath may extend into the first sheath and the two sheaths may interlock and prevent liquid from contacting the conductive dome region or the conductive contact pad.

Figure 1:
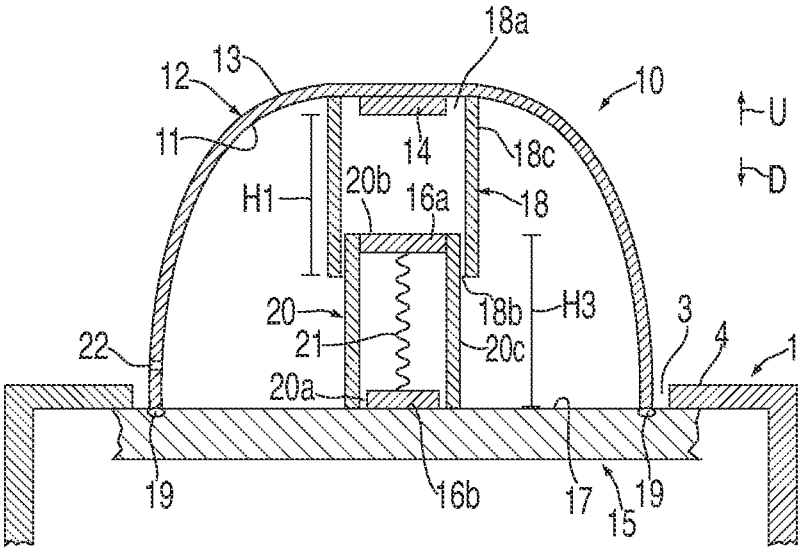
FIG. 1 is a partial cross-sectional view of an illustrative dome switch having two sheaths in accordance with some embodiments of the invention.

FIG. 1 is a partial cross-sectional view of an illustrative dome switch 10 of an electronic device 1. Switch 10 may be provided through an opening 3 of an outer housing 4 of electronic device 1 such that dome 10 may be accessible to a user of the device. Electronic device 1 may be a portable media device (e.g., an iPod™ or iPhone™ available from Apple, Inc. of Cupertino, Calif.) or a personal media device accessory (e.g., an audio controller for a media device or an in-line microphone with an input mechanism). Dome switch 10 may include a dome 12 coupled to a mounting surface 17. Surface 17 may be any suitable surface of device 1, such as the surface of a circuit board 15 or any other suitable portion of electronic device 1. Dome 12 may include an inner surface 11, an outer surface 13, and an air hole 22 provided therebetween for releasing air into the atmosphere when dome 12 is deformed. Switch 10 may also include a conductive contact region 14 coupled to inner surface 11 of dome 12 and at least one conductive contact pad 16 coupled to a mounting surface 17. For example, as further described with respect to FIG. 1A, switch 10 may include a raised contact pad 16*a* that may be coupled to a portion of sheath 20 extending from surface 17. On the other hand, as further described with respect to FIG. 15, switch 10 may include a mounted contact pad 16*b* that may be coupled to mounting surface 17. In some embodiments, switch 10 may include both raised contact pad 16*a* and mounted contact pad 16*b*, which may be electrically coupled to one another via a wire 21, for example. In other embodiments, switch 10 may only include raised contact pad 16*a*, which may be coupled to circuit board 15 of device 1 via wire 21, for example. In yet other embodiments, switch 10 may only include mounted contact pad 16*b* and not raised contact pad 16*a* (see, e.g., FIG. 1B).

Dome 12 may be made from any suitable deformable material, such that, when a user presses outer surface 13 in substantially the direction of arrow D towards surface 17, dome 12 may deform in such a way that conductive contact region 14 may contact conductive contact pad 16. When conductive contact region 14 contacts conductive contact pad 16, an electrically conductive path may be created therebetween, thereby switching a circuit that can be detected by electronic device 1. For example, dome 12 may be made from rubber or silicone. In some embodiments, dome 12 or at least inner surface 11 may be made from a conductive material, such as metal (e.g., aluminum or steel). In such embodiments, inner surface 11 itself may be conductive contact region 14.

Dome 12 may have any suitable shape. For example, dome 12 may have a semi-spherical or polygonal shape. In some embodiments, the shape of dome 12 may be determined or selected based on restrictions or limitations of device 1, circuit board 15, conductive contact region 14, and/or conductive contact pad 16. The shape of outer surface 13 may be determined or selected based on a predetermined force or range of forces that may be applied to dome 12 in direction D by an average user such that dome 12 may deform while remaining within a predetermined foot print on surface 17.

Dome 12 may be coupled to mounting surface 17 (e.g., a surface of circuit board 15) using any suitable approach such that, when a user deforms dome 12, conductive contact region 14 of inner surface 11 may contact conductive contact pad 16. For example, dome 12 may be coupled to mounting surface 17 using an adhesive or tape (e.g., see adhesive 19 of FIG. 1A). When contact region 14 and contact pad 16 contact each other, an electrically conductive path may be created, which may switch a circuit that can be detected by electronic device 1 (e.g., by a processor or other device component coupled to circuit board 15.)

Dome 12 may be sized using any suitable approach. For example, dome 12 may be sized based on the size of electronic device 1 or based on the size of contact pad 16. Dome 12 may have any suitable mechanical properties such that, for example, the force needed to deform dome 12 for adequately bringing contact region 14 into contact with contact pad 16 is a force able to be easily imparted by a user of device 1. Dome 12 may be manufactured using any suitable approach. In some embodiments, if dome 12 is metal, it may be stamped or punched from a sheet of metal. In other embodiments, dome 12 may be manufactured using molding, machining, cutting, forming, or through any other suitable manufacturing process.

Dome switch 10 may also include a first sheath 18 and a second sheath 20 for preventing liquid from harming the circuit elements of the switch. First sheath 18 may have any suitable shape for surrounding the periphery of contact region 14 on inner surface 11 of dome 10 and for fitting over second sheath 20. For example, first sheath 18 may have a cylindrical or conical sheath portion 18*c* extending between a first open end 18*a* coupled to inner surface 11 about contact region 14 and a second open end 18*b*, and second sheath 20 may have a cylindrical or conical sheath portion 20*c* extending between a first open end 20*a* coupled to surface 17 and a second open end 20*b*. When a user applies pressure to external surface 13 of dome 12, at least a portion of second sheath 20 may extend into first sheath 18 through second end 18*b*. Second sheath 20 may have any suitable shape for surrounding the periphery of contact pad 16 and for fitting within first sheath 18. For example, the shape of first open end 20*a* of second sheath 20 may be determined or selected based on the size of contact pad 16*b*, such that open end 20*a* may be coupled to surface 17 around the periphery of contact pad 16*b*.

First sheath 18 may be constructed from any suitable material such that, when a user applies pressure on outer surface 13 of dome 12 in the direction of arrow D, first sheath 18 may slide down around second sheath 20 such that contact region 14 may contact conductive contact pad 16. For example, first sheath 18 may be constructed from rubber, silicone, or a hydrophobic mesh.

First sheath 18 may be coupled to inner surface 11 of dome 12 using any suitable approach such that open end 18*a* of first sheath 18 may be positioned around conductive region 14 to prevent liquid external to sheath 18 from coming into contact with conductive region 14. For example, open end 18*a* of first sheath 18 may be coupled to inner surface 11 using any suitable adhesive. In some embodiments, if first sheath 18 is made from rubber or any other suitable material, for example, sheath 18 may be coupled to inner surface 11 of dome 12 by heating open end 18*a* of first sheath 18 such that it may be heat-sealed against inner surface 11 about conductive region 14.

Second sheath 20 may be constructed from any suitable material such that, when a user applies pressure on outer surface 13 of dome 12, first sheath 18 may slide over second sheath 20 and may allow conductive region 14 of dome 12 to come into contact with contact pad 16 for example, second sheath 20 may be constructed from rubber, silicone, or a hydrophobic mesh.

First end 20*a* of second sheath 20 may be coupled to surface 17 using any suitable approach such that a portion of second sheath 20 may be positioned around the periphery of contact pad 16 to prevent liquid external to sheath 20 from coming into contact with contact pad 16. For example, second sheath 20 may be coupled to surface 17 using an adhesive. In some embodiments, at least open end 20*a* of sheath 20 may be made at least partially from rubber, or any other suitable material, for example, such that open end 20*a* of sheath 20 may be coupled to surface 17 by heating end 20*a* of second sheath 20 such that sheath 20 may be heat-sealed against surface 17 (e.g., about contact pad 16*b*).

First sheath and second sheath 20 may be manufactured using any suitable approach. In some embodiments, each sheath may be manufactured using molding, machining, cutting, forming, or any other suitable manufacturing process.

Conductive contact pad 16 may be coupled to any suitable portion of surface 17 or sheath 20 such that when conductive region 14 and contact pad 16 of switch 10 contact each other, a circuit of device 1 (e.g., a circuit of circuit board 15) may be switched. Contact pad 16 may be constructed from copper or any other suitable material. Conductive contact pad 16 (e.g., conductive contact pad 16*b*) may be coupled to surface 17 using any suitable coupling approach. For example, contact pad 16*b* may be coupled to surface 17 through soldering. Conductive contact pad 16 (e.g., pad 16*a* may be coupled to sheath 20 (e.g., near end 20)) using any suitable approach, such as with an adhesive. Conductive contact pad 16 may be sized using any suitable approach. For example, contact pad 16 may be sized based on the sizes of first sheath 18 and second sheath 20. Conductive contact pad 16 may be manufactured using any suitable approach. In some embodiments, contact pad 16 may be manufactured using machining and/or cutting. In some embodiments, contact pad 16 may be manufactured with circuit board 15 of device 1. In some embodiments, pad 16 may be physically coupled to mounting surface 17 that is not part of circuit board 15, but pad 16 may be electrically coupled to circuit board 15 using any suitable approach (e.g., using wire 21).

Figure 1A:
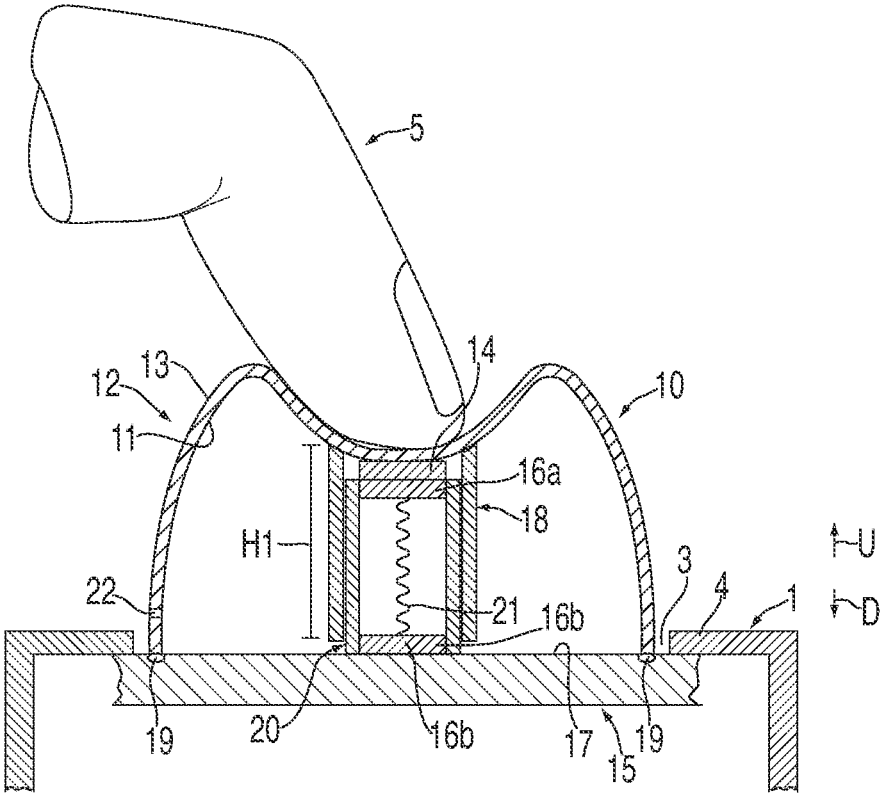
FIG. 1A is a partial cross-sectional view of the illustrative dome switch of FIG. 1 in a deformed state in accordance with some embodiments of the invention.

In some embodiments, first sheath 18 and/or second sheath 20 may be substantially rigid and may not deform when dome 12 deforms in response to a user's force. In such embodiments, as shown in FIG. 1 and FIG. 1A, when a user 5 applies pressure to outer surface 13, dome 12 may deform such that conductive region 14 of inner surface 11 may come into contact with contact pad 16*a* provided near end 20*b* of second sheath 20. When conductive region 14 contacts contact pad 16*a*, an electrically conductive path may be created between conductive region 14 and contact pad 16*a*, which may switch a circuit that can be detected by electronic device 1 (e.g., by circuit board 15 via wire 21 and optional contact pad 16*b*). As dome 12 deforms, at least a portion of second sheath 20 (e.g., second open end 20*b*) may extend into first sheath 18 through second open end 18*b* of first sheath 18, such that first sheath 18 and second sheath 20 may interlock and form a liquid proof environment for conductive region 14 and conductive pad 16*a*. As shown, for example, the height of first sheath 18 may remain height H1 when dome 12 is in its un-deformed state of FIG. 1 and its deformed state of FIG. 1A. Second sheath 20 may also remain in its same shape when dome 12 is deformed and not deformed.

Figure 1B:
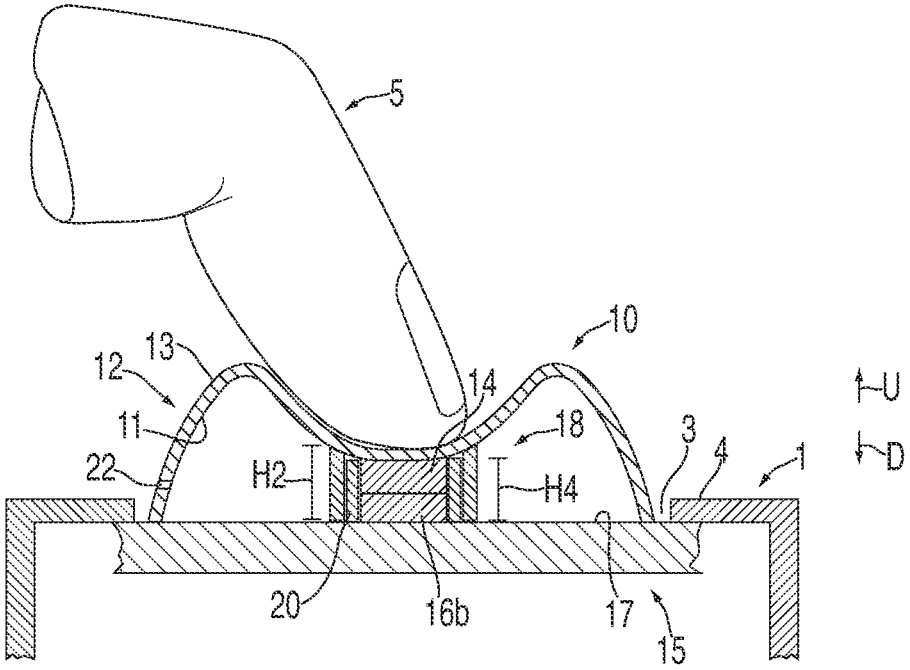
FIG. 1B is a partial cross-sectional view of the illustrative dome switch of FIG. 1 in a deformed state in accordance with some other embodiments of the invention.

However, in other embodiments, switch 10 may not include raised contact pad 16*a* and for example, as shown in FIG. 1B, sheath 18 and/or sheath 20 may deform when dome 12 is deformed by a user. When a user 5 applies pressure to outer surface 13, dome 12 may deform such that conductive region 14 contacts conductive contact pad 16*b* on surface 17. As dome 12 deforms, first sheath 18 and second sheath 20 may interlock and compress such that conductive region 14 may contact conductive contact pad 16. In such embodiments, at least one of first sheath 18 and second sheath 20 may compress (e.g., as described with respect to FIGS. 2-4A) to allow contact region 14 to travel in the D direction to contact conductive contact pad 16. For example, as shown in FIG. 1B, the height of first sheath 18 may compress from a first height H1 to a compressed height H2 when dome 12 is deformed by a user 5. For example, end 18*b* of sheath 18 may contact surface 17 and deform from height H1 to height H2 when user 5 presses dome 12 in direction D. Second sheath 20 may also deform from a first height H3 to a second height H4 when user 5 deforms dome 12. For example, end 20*b* of sheath 20 may contact inner surface 11 of dome 12 and deform from height H3 to height H4 when user 5 presses dome 12 in direction D. In some embodiments, sheath 18 and sheath 20 may be sized such that sheath 18 extending from dome 12 may extend into sheath 20 extending from surface 17 when dome 12 is deformed, as opposed to sheath 20 extending into sheath 18, as shown.

Figure 2:
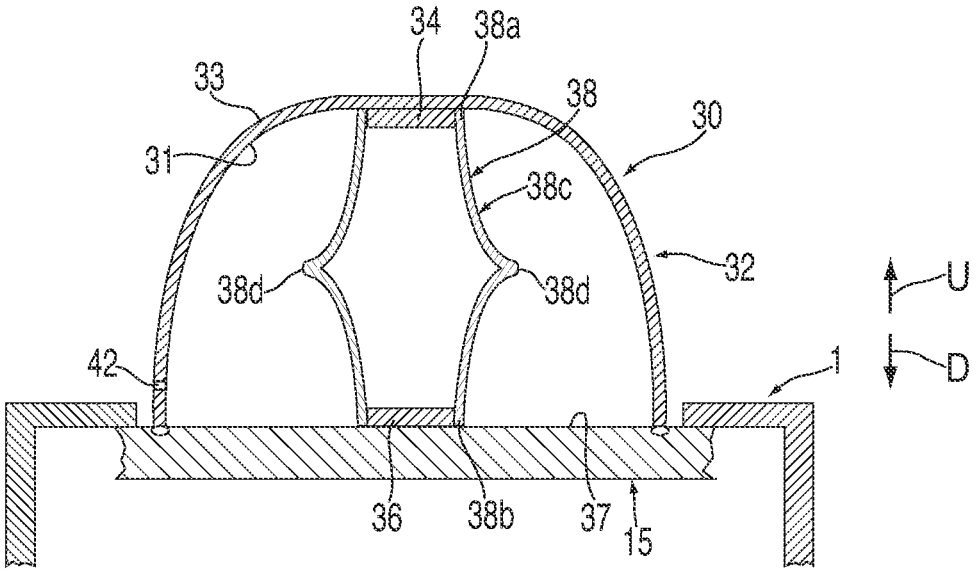
FIG. 2 is a partial cross-sectional view of an illustrative dome switch having a single sheath in accordance with some embodiments of the invention.

FIG. 2 is a partial cross-sectional view of an illustrative dome switch 30 of electronic device 1. Dome switch 30 may include a dome 32 coupled to a mounting surface 37, which may be any suitable surface of device 1, such as a surface of circuit board 15. Dome 32 may include an inner surface 31, an outer surface 33, and an air hole 42 provided therebetween for releasing air into the atmosphere when dome 32 is deformed. Switch 30 may include a conductive contact region 34 coupled to inner surface 31 of dome 32 and a conductive contact pad 36 coupled to surface 37. Switch 30 may also include a sheath 38 that has a sheath portion 38*c* extending between a first open end 38*a* and a second open end 38*b*. End 38*a* of sheath 38 may be coupled to inner surface 31 of dome 32 around conductive region 34 of inner surface 31 to prevent liquid external to sheath 38 from contacting conductive region 34. End 38*b* of sheath 38 may be coupled to surface 37 around contact pad 36 to prevent liquid external to sheath 38 from contacting contact pad 36.

Figure 2A:
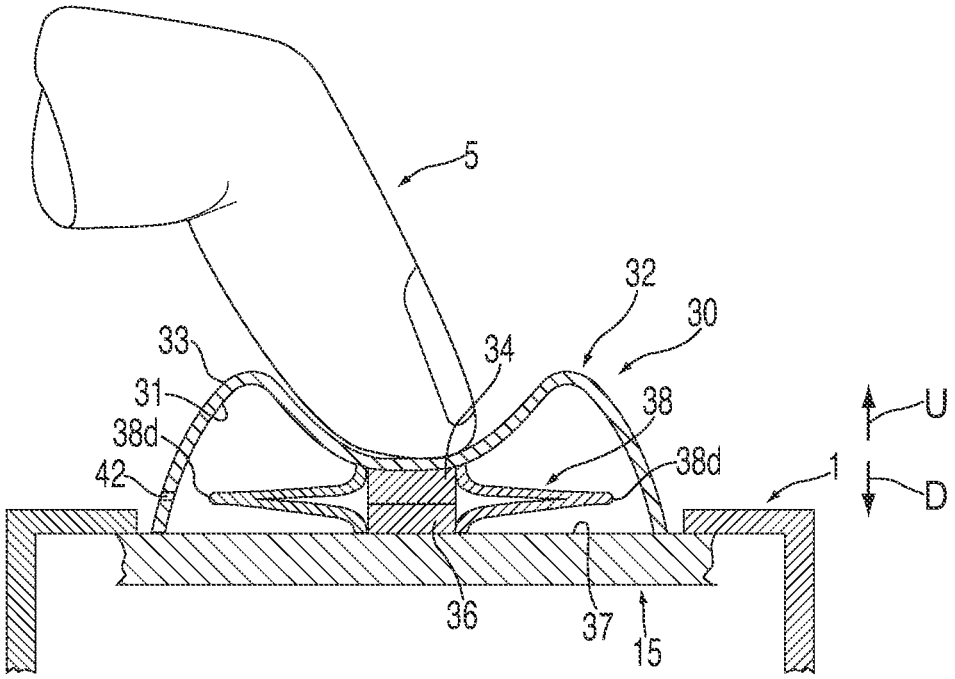
FIG. 2A is a partial cross-sectional view of the illustrative dome switch of FIG. 2 in a deformed state in accordance with some embodiments of the invention.

When user 5 pushes down on outer surface 33 in the direction of arrow D, dome 32 may deform such that contact region 34 may contact conductive contact pad 36 as shown in FIG. 2A. When contact region 34 contacts contact pad 36, an electrically conductive path may be created between contact region 34 and contact pad 36, which may switch a circuit that can be detected by electronic device 1. As dome 32 deforms, sheath 38 may be compressed such that end 38*a* and end 38*b* of sheath 38 may move towards one another. Further, mid-region 38*d* of sheath portion 38*c* of sheath 38 may expand outwardly (e.g., in a direction perpendicular to that of arrow D) as sheath 38 compresses. Sheath 38 may be made of suitable material such as rubber, silicone, or a hydrophobic mesh and may be coupled to switch 30 similar to how sheaths 18 and 20 may be coupled to switch 10.

Figure 3:
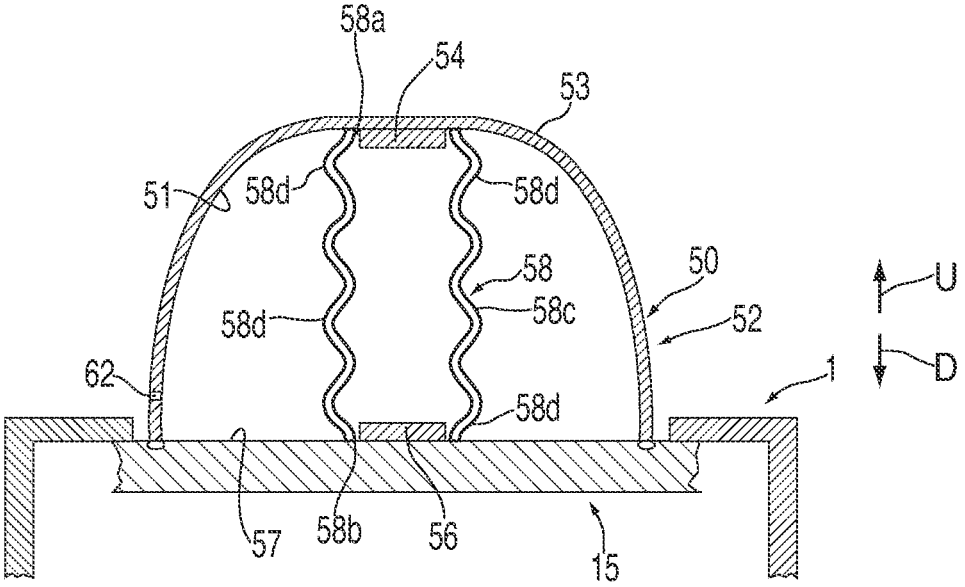
FIG. 3 is a partial cross-sectional view of another illustrative dome switch having a single sheath in accordance with some embodiments of the invention.

FIG. 3 is a partial cross-sectional view of an illustrative dome switch 50 of electronic device 1. Dome switch 50 may include a dome 52 coupled to a surface 57, which may be any suitable surface of device 1, such as a surface of circuit board 15. Dome 52 may include an inner surface 51, an outer surface 53, and air hole 62 provided therebetween for releasing air into the atmosphere when dome 52 is depressed. Dome switch 50 may also include a conductive contact region 54 coupled to inner surface 51 of dome 52 and a conductive contact pad 56 coupled to surface 57. Switch 50 may also include a sheath 58 that has a sheath portion 58*c* extending between a first open end 58*a* and a second open end 58*b*. End 58*a* of sheath 58 may be coupled to inner surface 51 of dome 52 around conductive contact region 54 of inner surface 51 of dome 52 to prevent liquid external to sheath 58 from contacting contact region 54. End 58*b* of sheath 58 may be coupled to surface 57 around contact pad 56 to prevent liquid external to sheath 58 from contacting contact pad 56.

Figure 3A:
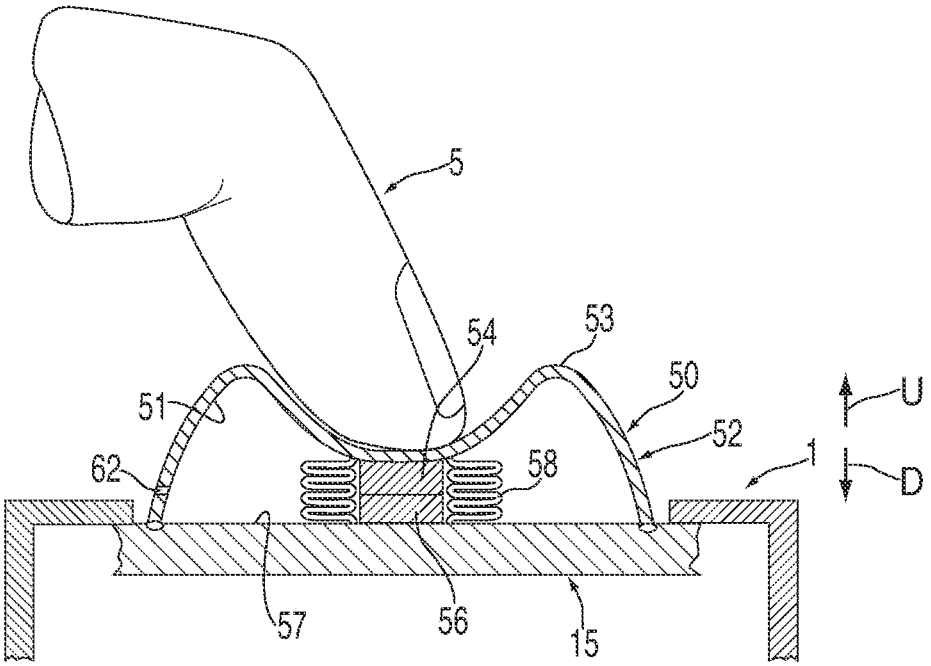
FIG. 3A is a partial cross-sectional view of the illustrative dome switch of FIG. 3 in a deformed state in accordance with some embodiments of the invention.

In operation, when user 5 pushes down on outer surface 53 in the direction of arrow D, dome 52 may deform such that conductive contact region 54 can contact conductive contact pad 56, as shown in FIG. 3A. When contact region 54 contacts contact pad 56, an electrically conductive path may be created between contact region 54 and contact pad 56, which may switch a circuit that can be detected by electronic device 1. As dome 52 deforms, sheath 58 may compress like an accordion or in any suitable fashion, such that one or more fold portions 58*d* may bend and reduce the height of sheath 58 between ends 58*a* and 58*b*, and such that open end 58*a* and open end 58*b* of sheath 58 may move towards one another.

Figure 4:
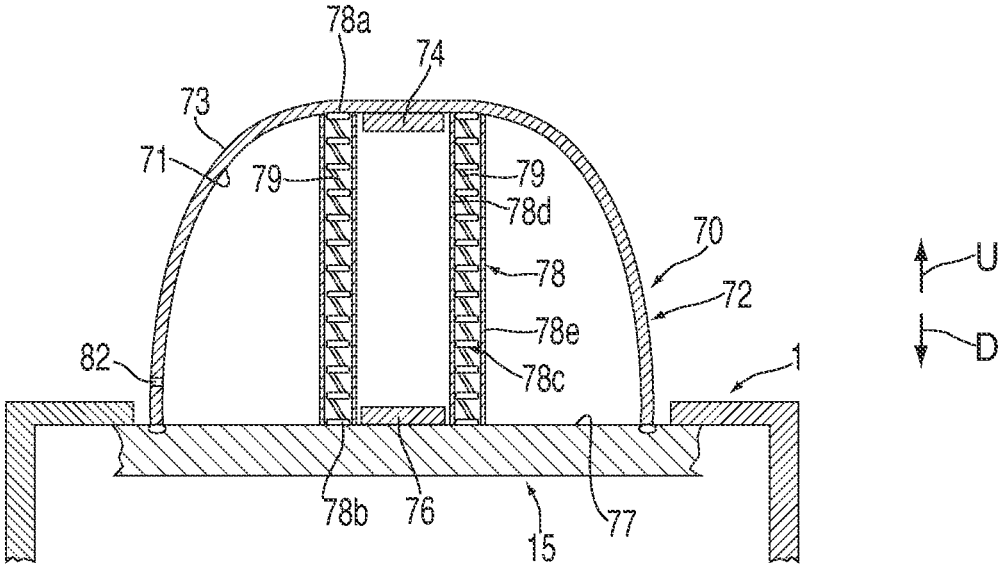
FIG. 4 is a partial cross-sectional view of yet another illustrative dome switch having a single sheath in accordance with some embodiments of the invention.

FIG. 4 is a partial cross-sectional view of an illustrative dome switch 70 of electronic device 1. Dome switch 70 may include a dome 72 coupled to a mounting surface 77, which may be any suitable surface of dome 1, such as of circuit board 15. Dome 72 may include inner surface 71, outer surface 73, and an air hole 82 provided therebetween for releasing air into the atmosphere when dome 72 is deformed. Switch 70 may include a conductive contact region 74 coupled to inner surface 71 of dome 72 and a conductive contact pad 76 coupled to surface 77. Switch 70 may also include a sheath 78 that has a sheath portion 78*c* extending between a first open end 78*a* and a second open end 78*b*. Sheath 78 may also include one or more springs 79 embedded between inner sheath 78*d* and outer sheath 78*e* of sheath portion 78*c*. Spring 79 may be provided within or about one sheath or may be between two sheaths as shown in FIG. 4. End 78*a* of sheath 78 may be coupled to inner surface 71 of dome 72 around contact region 74 of inner surface 71 of dome 72 to prevent liquid external to sheath 78 from contacting contact region 74. End 78*b* of sheath 78 may be coupled to surface 77 around contact pad 76 to prevent liquid external to sheath 78 from contacting contact pad 76.

Spring 79 may be constructed from any suitable material such that when user 5 applies pressure to outer surface 73 of dome 72 in direction of arrow D, spring 79 along with sheath 78 may compress, allowing contact region 74 of dome 72 to contact conductive contact pad 76. For example, spring 79 may be constructed from high-carbon alloys, chrome silicone, chrome vanadium, or stainless steel.

Spring 79 may be manufactured using any suitable approach. In some embodiments, spring 79 may be manufactured using machining, cold and/or hot winding, cutting, forming, or any other suitable manufacturing process. Inner and outer sheaths 78*d* and 78*e* along with spring 79 embedded therebetween may be operative to compress, bringing the coils of spring 79 closer together when user 5 applies force to outer surface 73 in direction of arrow D and then returning to its original state when the force is removed by having the coils of spring 79 move apart. In some embodiments, dome 72 may not have to return to its undeformed state on its own after user 5 stops applying a force to dome 72 in direction D. Instead, dome 72 may be returned to its undeformed state by coils of spring 79 moving apart and increasing the height of sheath 78, thereby moving portions of dome 72 upward in the direction of arrow U.

Figure 4A:
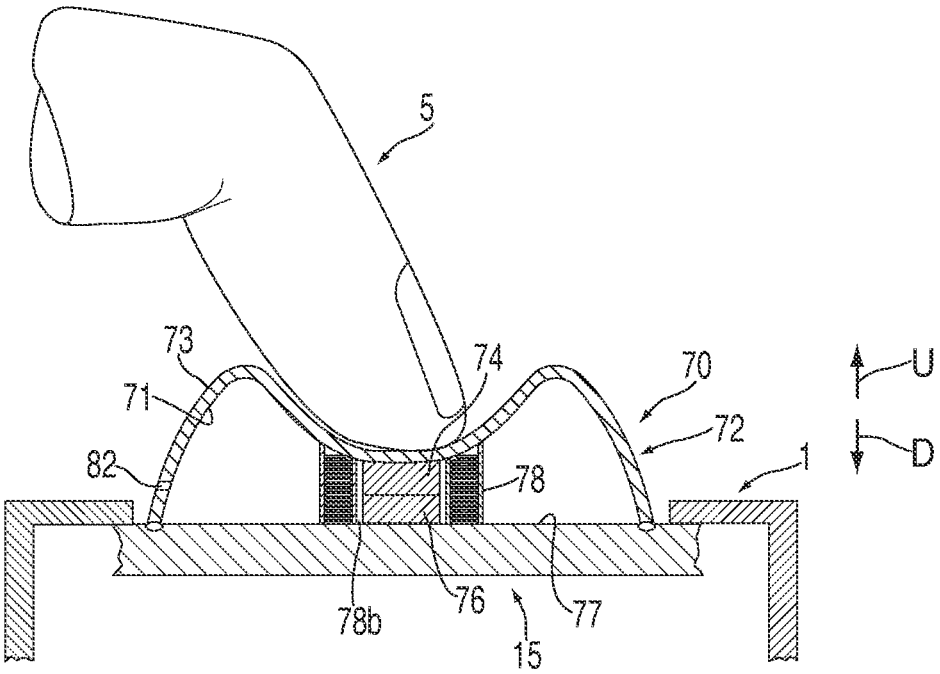
FIG. 4A is a partial cross-sectional view of the illustrative dome switch of FIG. 4 in a deformed state in accordance with some embodiments of the invention.

In operation, when user 5 pushes down on outer surface 73 in the direction of arrow D, dome 72 may deform such that contact region 74 comes into contact with contact pad 76, as shown in FIG. 4A. When contact region 74 contacts contact pad 76, an electrically conductive path may be created between contact region 74 and contact pad 76, which may close a circuit that can be detected by electronic device 1.

The above described embodiments of the invention are presented for purposes of illustration and not of limitation.

What is claimed is:

1. A dome switch assembly comprising:

a dome comprising an inner surface;

a contact pad coupled to a mounting surface and positioned underneath the dome; and a sheath, wherein a first end of the sheath is coupled to the inner surface of the dome about a conductive region of the inner surface of the dome, wherein a second end of the sheath is coupled to the mounting surface about the contact pad, wherein a portion of the dome is fixed to the mounting surface at least partially about the second end of the sheath, wherein the sheath comprises a spring extending along at least a portion of the sheath between the inner surface of the dome and the mounting surface, and wherein the spring extends along the entire sheath between the inner surface of the dome and the mounting surface.

2. A dome switch assembly comprising:

a dome comprising an inner surface;

a contact pad coupled to a mounting surface and positioned underneath the dome; and a sheath, wherein a first end of the sheath is coupled to the inner surface of the dome about a conductive region of the inner surface of the dome, wherein a second end of the sheath is coupled to the mounting surface about the contact pad, wherein a portion of the dome is fixed to the mounting surface at least partially about the second end of the sheath, and wherein the position of the portion of the dome with respect to the mounting surface is static when the conductive region of the inner surface of the dome is moved towards the contact pad.

3. The dome switch assembly of claim 2, wherein the dome is operative to deform, and wherein the conductive region of the inner surface is operative to contact the contact pad when the dome is deformed.

4. The dome switch assembly of claim 2, wherein the sheath is operative to compress when the dome is deformed.

5. A dome switch comprising:

a dome comprising a conductive region on an inner surface of the dome;

a contact pad positioned under the dome; and a sheath comprising a spring, wherein each one of the sheath and the spring extends about any space between the conductive region of the dome and the contact pad, wherein the dome deforms when a portion of the dome is moved towards the contact pad, and wherein the spring compresses when the dome is deformed.

6. The dome switch of claim 5, wherein the sheath comprises a first sheath layer reinforced by the spring.

7. The dome switch of claim 5, wherein the sheath comprises a first sheath layer and a second sheath layer, and wherein the spring is positioned between the first sheath layer and the second sheath layer.

8. The dome switch of claim 5, wherein the spring comprises at least one of a high-carbon alloy, chrome silicone, chrome vanadium, and stainless steel.

9. The dome switch of claim 5, wherein the contact pad is coupled to a supporting surface, wherein a first end of the sheath is coupled to the inner surface of the dome about a periphery of the conductive region, and wherein a second end of the sheath is coupled to the supporting surface about a periphery of the contact pad.

10. The dome switch assembly of claim 2, wherein the sheath prevents liquid external to the sheath from contacting at least one of:

the conductive region of the inner surface of the dome; and the contact pad.

11. The dome switch assembly of claim 2, wherein the dome further comprises an outer surface and an air hole between the inner surface and the outer surface.

12. The dome switch assembly of claim 11, wherein the air hole is positioned outside of the conductive region of the inner surface of the dome region.

13. The dome switch assembly of claim 2, wherein the dome is coupled to the mounting surface.

14. The dome switch assembly of claim 2, wherein the sheath comprises a spring extending along at least a portion of the sheath between the inner surface of the dome and the mounting surface.

15. The dome switch of claim 5, wherein the spring moves the conductive region of the dome away from the contact pad.

16. The dome switch of claim 5, wherein the sheath prevents liquid external to the sheath from contacting at least one of:

the conductive region of the dome; and the contact pad.

17. The dome switch of claim 5, wherein the spring compresses to enable contact between the conductive region of the dome and the contact pad within the sheath.

18. The dome switch of claim 5, wherein the sheath comprises a compressible sheath body extending between a first sheath end and a second sheath end, and wherein:

the first sheath end is coupled to the dome about the conductive region; and the second sheath end is positioned about the contact pad.

19. The dome switch of claim 18, further comprising a support structure, wherein:

the contact pad is coupled to the support structure; and the second sheath end is coupled to the support structure about the contact pad.

20. The dome switch of claim 18, wherein the sheath prevents liquid external to the sheath from contacting:

the conductive region; and the contact pad.

21. The dome switch of claim 18, wherein the first sheath end is at least one of adhered to the dome about the conductive region and heat-sealed to the dome about the conductive region.

22. The dome switch assembly of claim 2, wherein the portion of the dome is adhered to the mounting surface.

23. The dome switch of claim 5, wherein the conductive region is operative to contact the contact pad when the dome is deformed.

24. The dome switch assembly of claim 2, wherein:

the dome deforms when the conductive region of the inner surface of the dome is moved towards the contact pad; and the sheath compresses when the dome is deformed.

* * * * *